United States Patent [19]

Menown

[11] Patent Number: 4,703,226

[45] Date of Patent: Oct. 27, 1987

[54] THYRATRON HAVING ANODE AND MULTIPLE GRIDS

[75] Inventor: Hugh Menown, Writtle, England

[73] Assignee: English Electric Valve Company Limited, Chelmsford, England

[21] Appl. No.: 810,302

[22] Filed: Dec. 18, 1985

[30] Foreign Application Priority Data

Dec. 22, 1984 [GB] United Kingdom ..... 8432613

[51] Int. Cl.[4] ..... H01J 1/46; H01J 15/02

[52] U.S. Cl. ..... 313/595; 313/599; 313/597

[58] Field of Search ..... 313/595, 597, 599, 600, 313/601, 602, 306, 310, 325

[56] References Cited

U.S. PATENT DOCUMENTS 3,612,937 10/1971 Smirnov et al. ..... 313/601

4,429,253 1/1984 Donaldson et al. ..... 313/599 X 4,577,138 3/1986 Menown et al. ..... 313/597 X

FOREIGN PATENT DOCUMENTS 2065962A 7/1981 United Kingdom .

*Primary Examiner*—David K. Moore

*Assistant Examiner*—K. Wieder

*Attorney, Agent, or Firm*—Spencer & Frank

[57] ABSTRACT

A thyratron includes an envelope containing a gas filling, an anode, an intermediate grid, control grids and a cylindrical structure which acts as a cathode heat shield in a conventional thyratron. In operation the intermediate grid is maintained at cathode potential and, when triggering pulses are applied to the control grids, the gas filling ionizes and the thyratron becomes conducting. The main part of the current comes from the intermediate grid which acts as a "hollow" cathode, and enables the thermionic cathode conventionally used to be dispensed with if desired.

9 Claims, 2 Drawing Figures

THYRATRON HAVING ANODE AND MULTIPLE GRIDS

BACKGROUND OF THE INVENTION

This invention relates to thyratrons and more particularly to cold cathode thyratrons.

Conventionally, thyratrons include an anode, a cathode and one or more control grids located between them, contained within an envelope which also contains a gas filling, typically of hydrogen. A thyratron may typically also have a screen grid between the anode and the control grid or grids. The cathode in a conventional thyratron is generally a thermionic cathode in which electrons are emitted by a thermionic material when it reaches a required temperature, a cathode heater being included to achieve this. Some disadvantages arise from such an arrangement. A supply must be provided for the cathode heater, and it takes the thermionic material a relatively long time (minutes) to reach the temperature required for satisfactory operation of the thyratron.

SUMMARY OF THE INVENTION

According to the invention there is provided a thyratron comprising an anode, a control grid and an intermediate grid located between them, the intermediate grid being arranged to partly enclose a volume and to be at cathode potential during operation, whereby, when the thyratron is in a conducting state at least a substantial part of the current is derived from the said volume, and its boundaries, thus enabling a conventional thermionic cathode to be omitted.

The intermediate grid acts in what may be termed a "hollow cathode" mode of operation, in which processes originating in the gas discharge are responsible for the electron emission which is necessary for the intermediate grid to act as a cathode. Thus, thermionically emitting structures which constitute resistively heated cathodes in conventional thyratrons are not required in a thyratron in accordance with the invention.

It is preferred that the intermediate grid comprises first and second portions arranged to lie in substantially parallel first and second different planes respectively, so that the enclosed volume lies between the first and second portions. The intermediate grid could include a hollow cylindrical member between the portions to give a more completely enclosed volume.

Also it is preferred that the first portion comprises a disc member surrounded by an annulus member and separated from it by an arcuate aperture, and the second portion comprises another disc member surrounded by another annulus member and separated from it by an annular aperture, and also preferably the arcuate aperture and the annular aperture are coaxial and offset from one another on different radii.

Preferably the control grid is positioned between the intermediate grid and a cylindrical structure, the cylindrical structure being substantially coaxial with the longitudinal axis of the thyratron and being arranged to be at cathode potential during operation. For the purposes of this description, the longitudinal axis lies normal to the plane of the anode. The cylindrical structure may correspond to the cathode heat shield of a thyratron with a conventional cathode.

BRIEF DESCRIPTION OF THE FIGURES

The invention is now further described by way of example with reference to the accompanying drawings in which.

DETAILED DESCRIPTION

Figure 1:
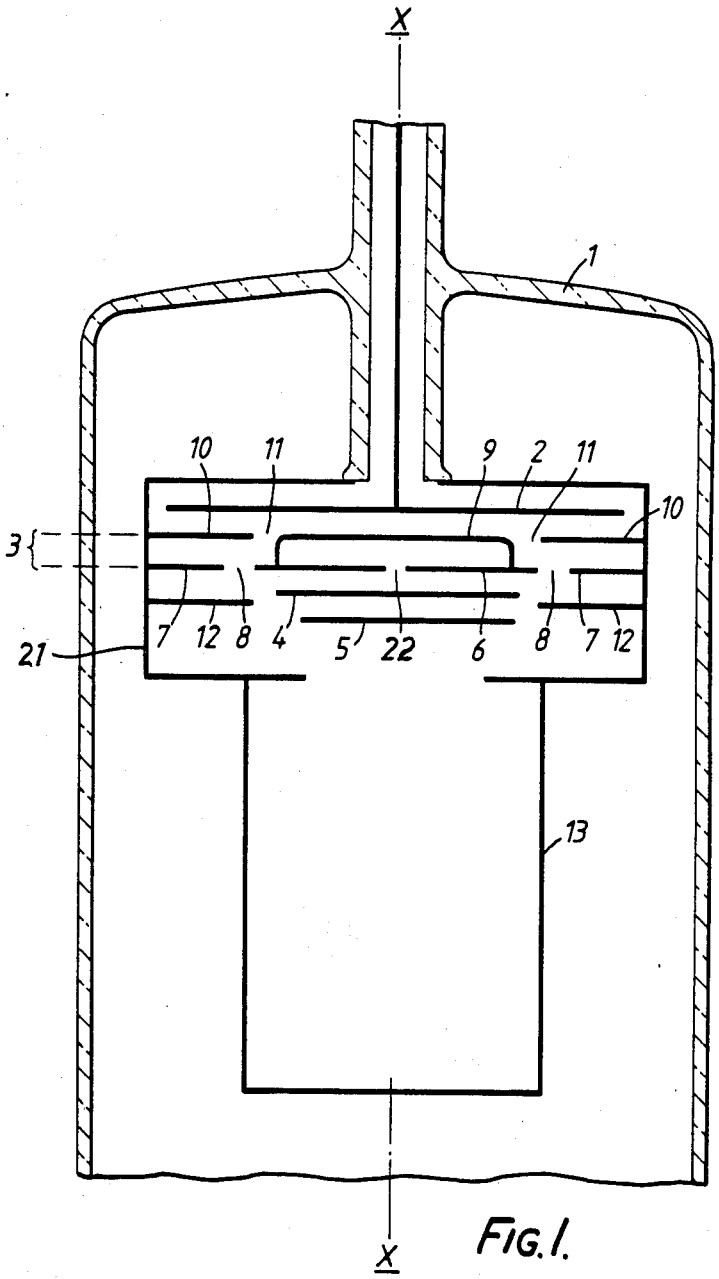
FIG. 1 is a schematic longitudinal section of a thyratron in accordance with the invention.

With reference to FIG. 1, a thyratron has a substantially cylindrical symmetry and includes a glass envelope 1 within which is contained a hydrogen gas filling and, spaced along and substantially perpendicular to its longitudinal axis X—X, an anode 2, an intermediate grid 3 and two control grids 4 and 5.

The intermediate grid 3 is positioned between the anode 2 and the control grid 4 to act as a screen grid. The intermediate grid 3 is a double layered structure, having surface portions in first and second substantially parallel planes. The surface portions in the first plane comprise a first disc 6 surrounded by a first annulus 7, the two parts being separated by three arcuate apertures 8.

The second plane lies between the first plane and the anode 2, and the surface portions, of the intermediate grid 3 in that plane comprise a second disc 9 surrounded by a second annulus 10. The disc 9 and annulus 10 are separated by an annular aperture 11, the second disc 9 being supported by its rim which is turned down and fixed to the surface of the first disc 6 to form an enclosure. A third annulus 12 is positioned to one side of the intermediate grid 3, the intermediate grid 3 lying between it and the anode 2. The intermediate grid 3 and the third annulus 12 are supported by a surrounding cylinder 21.

A cylindrical structure 13 is also enclosed within the glass envelope and is arranged such that the control grids 4 and 5 and the intermediate grid 3 are positioned between it and the anode 2. The cylindrical structure 13 corresponds to the cathode heat shield of a conventional thyratron in shape and position and is attached to the cylinder 21. However, this thyratron in accordance with the invention does not include cathode material or a cathode heater.

In one mode of operation, a positive pulse is applied to control grid 5 to cause breakdown of the hydrogen gas filling between that control grid 5 and the cylindrical structure 13 which is held at cathode potential. When the grid breakdown current reaches its maximum value a pulse is applied to the other control grid 4, causing breakdown of the gas through the apertures 8 and 11 to the anode 2, and the main discharge current of the thyratron builds up to render the thyratron conducting.

The main part of the current originates from the intermediate grid 3 which is maintained at cathode potential. The volume enclosed between the discs 6 and 9 of the intermediate grid 3 forms what may be termed a "hollow cathode". Processes in the enclosed volume result in electron emission from an aperture 22, in a direction away from the anode 2 in the illustrated embodiment.

The annuli 12, 7 and 10 are also maintained at cathode potential. They enhance the hollow cathode effect by combining with the cylinder 21 to provide further enclosed volumes.

Figure 2:
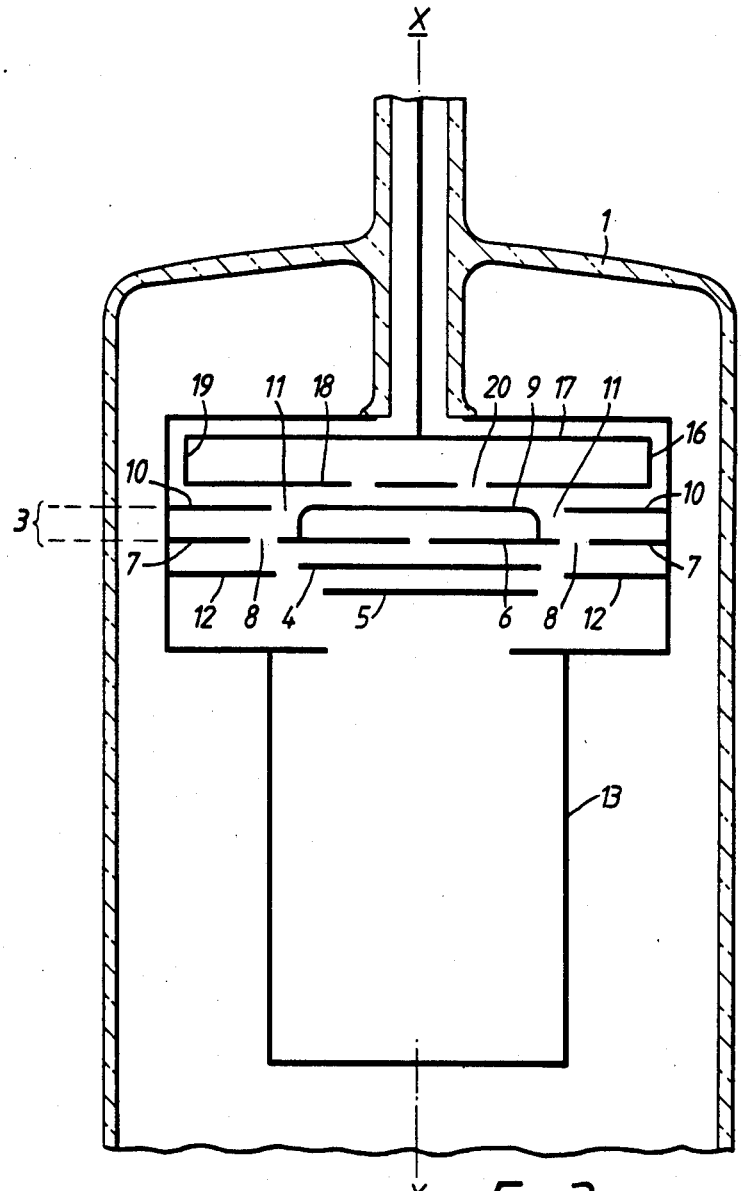
FIG. 2 is a schematic longitudinal section of another thyratron in accordance with the invention, with like references being used for like parts throughout.

With reference to FIG. 2, another thyratron in accordance with the invention is similar to that described above but includes an anode 16 which partly encloses a volume and comprises two portions 17 and 18 lying is substantially parallel planes and a cylindrical wall 19 between and joining them. One portion 18 nearest the cathode has an annular aperture 20 coaxial with the longitudinal axis X—X of the thyratron.

During operation a plasma builds up in and is contained within the enclosed volume of the anode 16. The thyratron is capable of high peak currents and is able to operate with a reverse current in the glow mode.

Although the thyratrons of the above described embodiments have a substantially cylindrical symmetry the invention can be applied to the thyratrons of other geometries, for example such as the so-called linear geometry akin to a rail gap.

I claim:

1. A thyratron comprising: an anode, a control grid and an intermediate grid located between said anode and said control grid, the intermediate grid being arranged to partly enclose a volume of gas filling and to be at cathode potential during operation, the intermediate grid having a surface with an aperture through which the volume of gas filling communicates with the region outside the intermediate grid, the surface with the aperture being disposed so that it does not directly face the anode, whereby, when the thyratron is in a conducting state, at least a substantial part of the current is derived from the said volume of gas filling.

2. A thyratron as claimed in claim 1 and wherein the intermediate grid comprises a first portion and a second portion arranged in substantially parallel first and second different planes respectively.

3. A thyratron as claimed in claim 2 and wherein said first portion comprises a first disc member surrounded by a first annular member and separated from it by an arcuate aperture, and the second portion comprises a second disc member surrounded by a second annular member and separated from it by an annular aperture, one of the first and second disc members having the surface with the aperture.

4. A thyratron as claimed in claim 3 and wherein said arcuate aperture and said annular aperture are coaxial and offset from one another.

5. A thyratron as claimed in claim 1 and wherein said control grid is positioned between said intermediate grid and a cylindrical structure, said cylindrical structure being substantially coaxial with the longitudinal axis of the thyratron and being arranged to be at cathode potential during operation.

6. A thyratron as claimed in claim 1 and wherein said anode is arranged to partly enclose a volume of gas filling.

7. A thyratron as claimed in claim 6 and wherein said anode comprises first and second portions arranged to lie in substantially parallel respective planes.

8. A thyratron as claimed in claim 1 and wherein the surface with the aperture directly faces the control grid.

9. A thyratron as claimed in claim 1 and wherein the current that is derived from the volume of gas filling flows through the aperture.

* * * * *